US007159480B2

(12) United States Patent
Yamauchi

(10) Patent No.: US 7,159,480 B2
(45) Date of Patent: Jan. 9, 2007

(54) PINION SLIP-OFF PREVENTIVE STRUCTURE OF STARTING APPARATUS

(75) Inventor: Hayato Yamauchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 501 days.

(21) Appl. No.: 09/881,108

(22) Filed: Jun. 15, 2001

(65) Prior Publication Data

US 2002/0096000 A1 Jul. 25, 2002

(30) Foreign Application Priority Data

Jan. 24, 2001 (JP) ..... 2001-016079

(51) Int. Cl.
*F02N 11/00* (2006.01)

(52) U.S. Cl. ..... 74/6; 74/7 R

(58) Field of Classification Search ..... 74/6, 74/7 R, 7 A, 7 B

See application file for complete search history.

(56) References Cited

U.S. PATENT DOCUMENTS 2,960,879 A * 11/1960 Lafitte ..... 74/6
3,299,719 A 1/1967 Toulier
3,599,496 A * 8/1971 Toulier ..... 74/7 R
3,791,685 A 2/1974 Hamman
4,116,077 A * 9/1978 Mazzorana ..... 74/7 A
4,366,385 A 12/1982 Williams

FOREIGN PATENT DOCUMENTS

DE 39 28 796 A * 7/1991
DE 4 218 625 A1 12/1992
EP 0 494 681 A1 7/1992
JP 64-56966 3/1989

* cited by examiner

*Primary Examiner*—William C. Joyce
(74) *Attorney, Agent, or Firm*—Sughrue Mion, PLLC

(57) ABSTRACT

A pinion slip-off preventive structure of a starting apparatus is provided in which a bearing applied to a snap ring 17 can be decreased to make the snap ring 17 less prone to being worn out and damaged, thus preventing the snap ring 17 from slipping off from a pinion shaft 7. The pinion slip-off preventive structure includes a projected portion 52 extending from an end face of the pinion shaft 7 in an axial direction thereof and having a groove 51 formed on a smooth surface thereof in a circumferential direction thereof, the snap ring 17 fitted in the groove 51, and a stopper 57 having an abutting surface 54 in abutting engagement with an end face of the pinion 9 and an engaging portion 56 engaged with the snap ring 17.

5 Claims, 6 Drawing Sheets

PINION SLIP-OFF PREVENTIVE STRUCTURE OF STARTING APPARATUS

This application is based on Application No. 2001-16079, filed in Japan on Jan. 24, 2001, the contents of which are hereby incorporated by reference.

BACKGROUND OF THE INVENTION

1. Field of the Invention

The present invention relates to a pinion slip-off preventive structure of a starting apparatus for preventing a pinion, pressed toward a ring gear side by means of an elastic member, from slipping off a pinion shaft.

2. Description of the Related Art

FIG. 5 is a partial cross sectional view of a known starting apparatus for an internal combustion engine.

The starting apparatus illustrated includes an electric motor (not shown) having a first gear 2 mounted on a shaft 1, a second gear 3 in meshing engagement with the first gear 2, a drive shaft 4 splined to the second gear 3, an electromagnetic member (not shown) having a plunger (not shown) driven to reciprocate by means of an electromagnetic coil (not shown), a shift lever 5 engaged at one end thereof with the plunger so that it is caused to rotate like a seesaw through a reciprocating movement of the plunger, a one-way clutch 6 being in abutting engagement with the other end of the shift lever 5 so that it is driven to reciprocate in an axial direction under the action of a pressing force of the shift lever 5, a pinion shaft 7 extending from the one-way clutch 6 in an axial direction thereof, a pinion 9 splined to a spline portion 8 formed at one end of the pinion shaft 7 and meshed with a ring gear or flywheel starter gear (not shown) of an internal combustion engine, an elastic member 10 for pressing the pinion 9, mounted on the one end of the pinion shaft 7, toward a ring gear side, and a pinion slip-off preventive structure 11 for preventing the pinion 9, pressed in a direction toward the ring gear by means of the elastic member 10, from coming or slipping off the pinion shaft 7.

The one-way clutch 6 includes a drive member 13 splined to a helical spline 12 formed on the drive shaft 4 and acting as a clutch outer member, and a driven member 15 formed integral with the pinion shaft 7 and acting as a clutch inner member.

As illustrated in FIG. 6, the pinion slip-off preventive structure 11 comprises a snap ring 17 of a C-shaped configuration fitted in a groove 16 formed on the spline portion 8 in a circumferential direction thereof, and a stopper 18 being in abutting engagement with an end face of the pinion 9 and having an engagement portion 19 engaging with the C-shaped snap ring 17.

With the starting apparatus for an internal combustion engine as constructed above, when an unillustrated starting switch is turned on, the unillustrated electromagnetic coil in the electromagnetic portion is supplied with electric power and energized to move the unillustrated plunger in one direction, whereby the shift lever 5 is caused to rotate in a seesaw-like manner to urge the one-way clutch 6 to the right in FIG. 5. As a result, the one-way clutch 6 is driven to move together with the pinion 9 while being rotated in accordance with a lead angle of the helical spline 12, so that the pinion 9 is placed into meshing engagement with the unillustrated ring gear. Thereafter, the unillustrated electric motor is energized to rotate its rotation shaft 1. The rotation force of the rotation shaft 1 of the motor is transmitted to the driven member 15 through the intermediary of the drive shaft 4, the drive member 13 and a roller 14, whereby the pinion shaft 7 and the pinion 9 made integral with the driven member 15 are caused to rotate together with the driven member 15. The rotation of the pinion 9 causes the ring gear meshed with the pinion 9 to rotate, thus starting the internal combustion engine.

Here, note that when the pinion 9 is not able to mesh with the ring gear, the elastic member 10 is thereafter compressed by the movement of the pinion shaft 7, and at the same time, the pinion 9 is forced to rotate under the action of the lead angle of the helical spline 12 so that it is placed into meshing engagement with the ring gear.

After the internal combustion engine has been started, the power supply to the electromagnetic coil is stopped so that the plunger is returned to its original position, which was taken prior to the energization of the electromagnetic coil, under the action of the elastic force of the elastic member in the electromagnetic portion. However, since the shift lever 5 is rotated in a seesaw-like manner in accordance with the movement of the plunger, the one-way clutch 6 is pushed to return to the original position as taken before the starting of the internal combustion engine. Thus, the meshing engagement between the pinion 9 and the ring gear is released.

Also, an unillustrated motor energizing switch is turned off to stop the power supply to the electric motor. As a result, the rotation of the drive shaft 4 stops and the starting apparatus of the internal combustion engine is returned to the original state as taken prior to engine starting.

With the pinion slip-off preventive structure 11 of the starting apparatus as described above, the snap ring 17 is fitted in the groove 16 formed on the spline portion 8, and the elastic load applied to the snap ring 17 from the elastic member 10 is supported by the spline portion 8, as illustrated in FIG. 7. Therefore, there arises a problem that a pressure-receiving area of the snap ring 17 becomes small, and hence the snap ring 17 is subjected to an accordingly increased bearing and is liable to be worn out and damaged, thus giving rise a fear that the pinion 9 may slip off the pinion shaft 7.

SUMMARY OF THE INVENTION

The present invention is intended to obviate the problem as referred to above, and has for its object to provide a pinion slip-off preventive structure of a starting apparatus in which the bearing applied to a snap ring can be decreased to make the snap ring less prone to being worn out and damaged, thus preventing the snap ring from slipping off from a pinion shaft.

Bearing the above object in mind, according to the present invention, there is provided a pinion slip-off preventive structure of a starting apparatus in which a pinion is prevented from slipping off a pinion shaft, the pinion being splined to a spline portion formed on the pinion shaft and being in meshing engagement with a ring gear of an internal combustion engine while urged in a direction toward the ring gear from a side remote therefrom by means of an elastic member. The pinion slip-off preventive structure comprises: a projected portion extending from an end face of the pinion shaft in an axial direction thereof and having a groove formed on a smooth surface thereof in a circumferential direction thereof; a snap ring fitted in the groove; and a stopper having an abutting surface in abutting engagement with an end face of the pinion and an engaging portion engaged with the snap ring.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Figure 5:
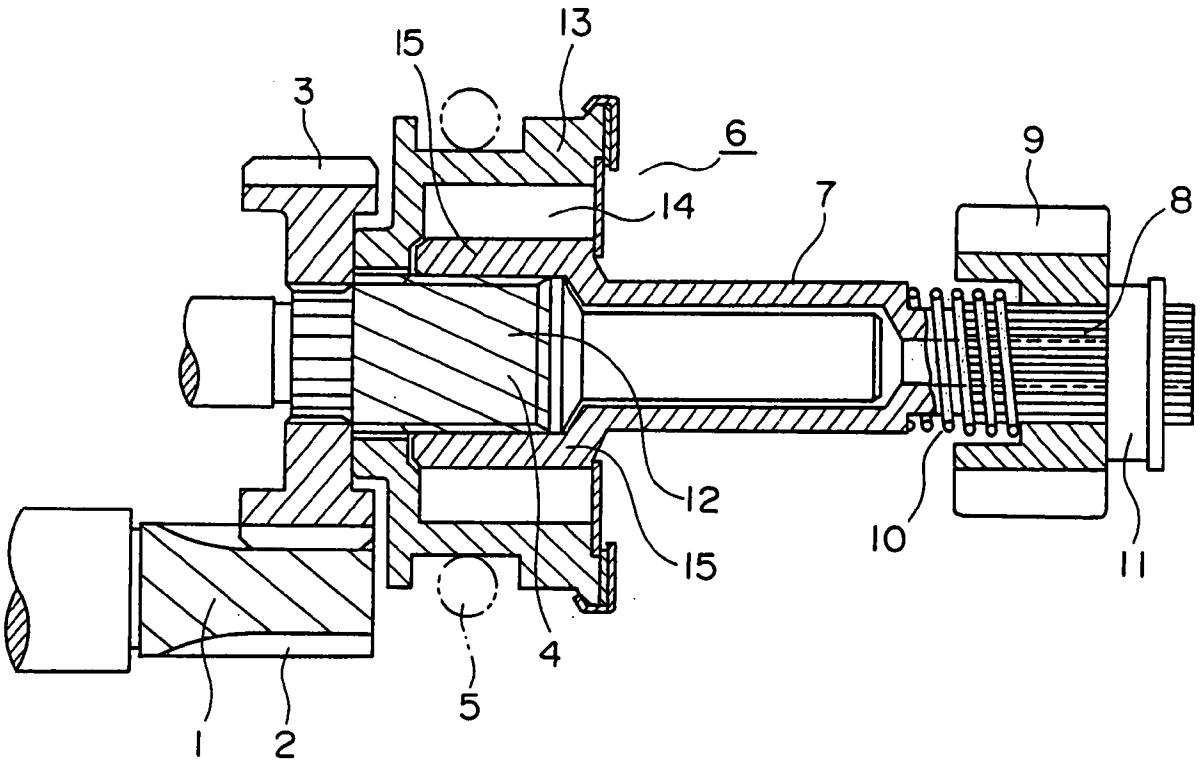
FIG. 5 PRIOR ART
FIG. 5 is a partial cross sectional view of a known starting apparatus for an internal combustion engine.
Figure 6:
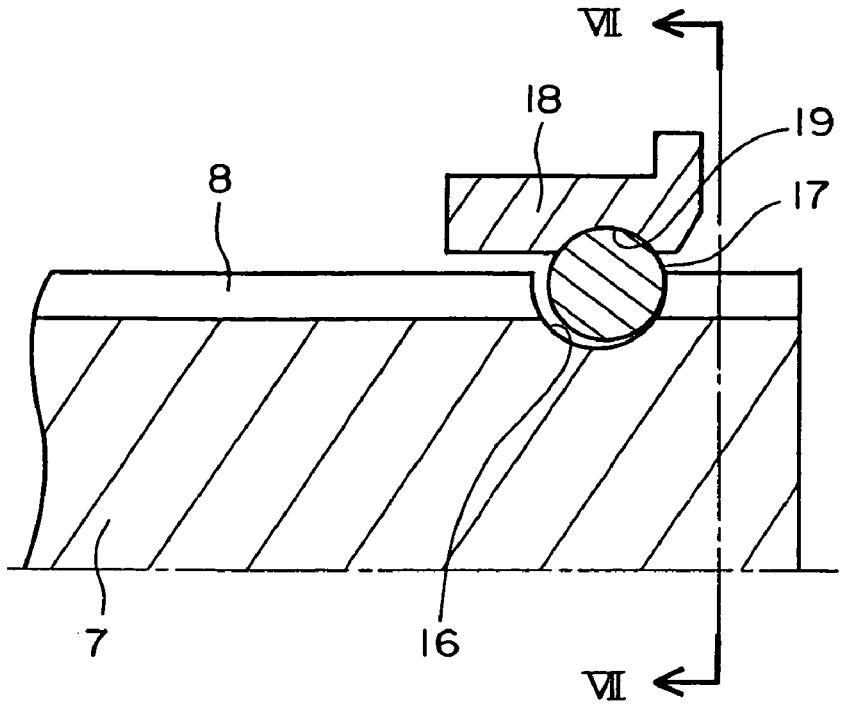
FIG. 6 PRIOR ART
FIG. 6 is an enlarged view of essential portions of FIG. 5.
Figure 7:
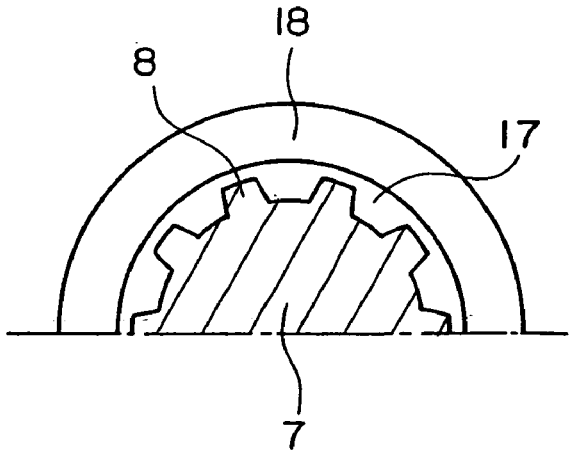
FIG. 7 PRIOR ART
FIG. 7 is a cross sectional view along line VII—VII in FIG. 6.

Now, preferred embodiments of the present invention will be described in detail while referring to the accompanying drawings. In the following description, the same or corresponding members or parts as those shown in FIG. 5 through FIG. 7 are identified by the same symbols.

Embodiment 1.

Figure 1:
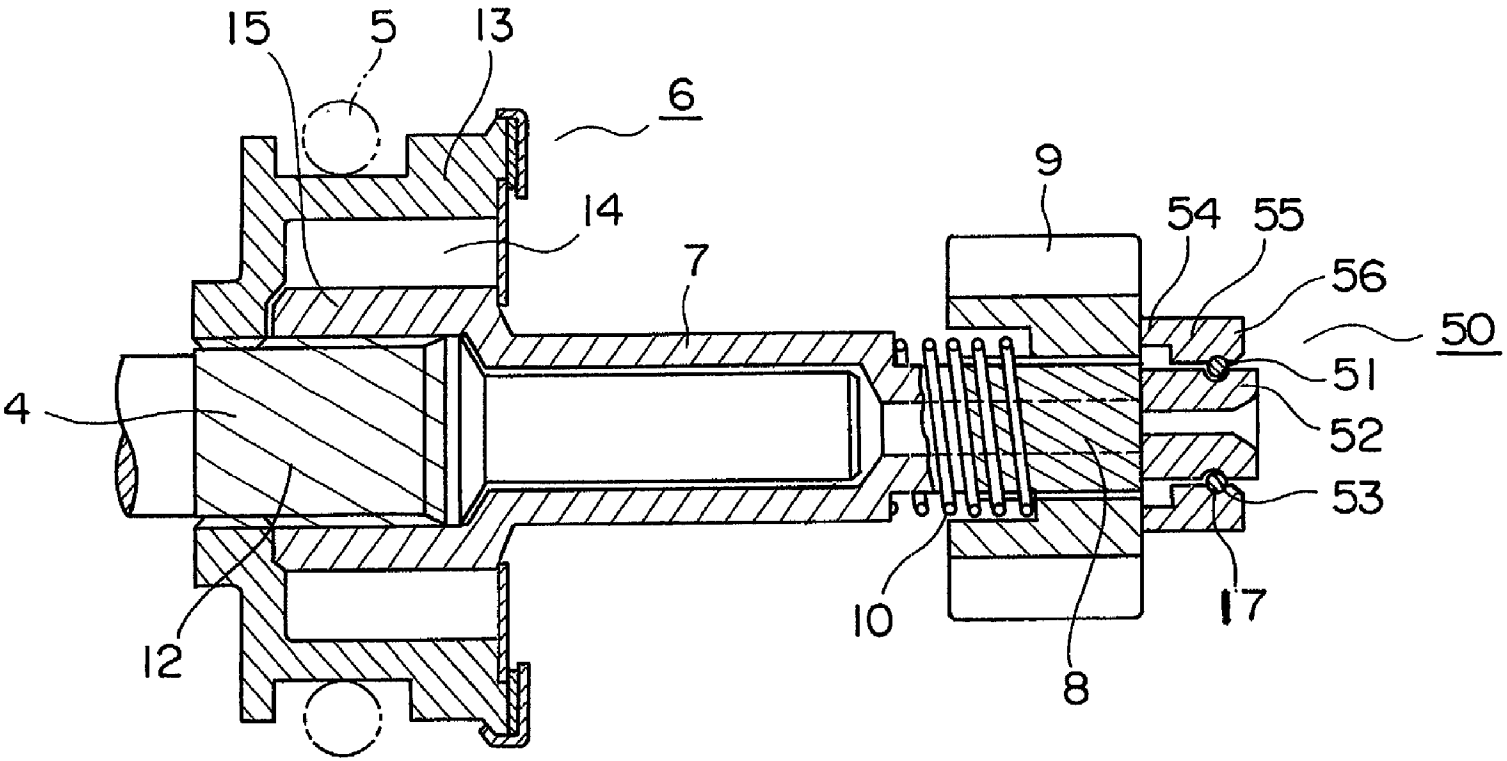
FIG. 1 is a partial cross sectional view of a starting apparatus for an internal combustion engine according to a first embodiment of the present invention.

FIG. 1 illustrates, in a partial cross section, a starting apparatus for an internal combustion engine according to the present invention. In this figure, the starting apparatus of this embodiment includes an electric motor (not shown) having a first gear (not shown) mounted on a shaft (not shown), a second gear 3 in meshing engagement with the first gear, a drive shaft 4 splined to the second gear, an electromagnetic member (not shown) having a plunger (not shown) driven to reciprocate by means of an electromagnetic coil (not shown), a shift lever 5 engaged at one end thereof with the plunger so that it is caused to rotate like a seesaw through a reciprocating movement of the plunger, a one-way clutch 6 being in abutting engagement with the other end of the shift lever 5 so that it is driven to reciprocate in an axial direction under the action of a pressing force of the shift lever 5, a pinion shaft 7 extending from the one-way clutch 6 in an axial direction thereof, a pinion 9 splined to a spline portion 8 formed at one end of the pinion shaft 7 and meshed with a ring gear or flywheel starter gear (not shown) of an internal combustion engine, an elastic member 10 for pressing the pinion 9, mounted on the one end of the pinion shaft 7, toward a ring gear side, and a pinion slip-off preventive structure 50 for preventing the pinion 9, pressed in a direction toward the ring gear by means of the elastic member 10, from coming or slipping off the pinion shaft 7.

The one-way clutch 6 includes a drive member 13 splined to a helical spline 12 formed on the drive shaft 4 and acting as a clutch outer member, and a driven member 15 formed integral with the pinion shaft 7 and acting as a clutch inner member.

Figure 2:
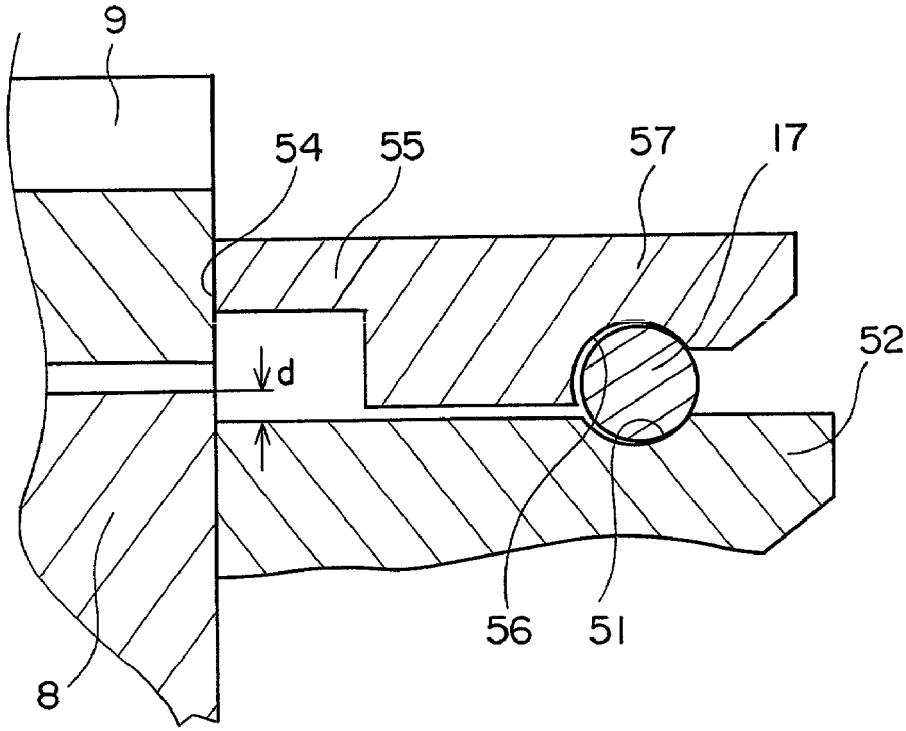
FIG. 2 is an enlarged view of essential portions of FIG. 1.

As illustrated in FIG. 2, the pinion slip-off preventive structure 50 comprises a projected portion 52 extending from one end face of the pinion shaft 7 in an axial direction thereof and having a groove 51 which is formed on a smooth surface so as to extend in a circumferential direction thereof, a snap ring 17 fitted in the groove 51 on the projected portion 52, and a stopper 57 which has an abutting surface 54 in abutting engagement with the one end of the pinion 9, a support portion 55 extending from the abutting surface 54 axially of the pinion 9 and an engaging portion 56 engaged with the snap ring 17.

The projected portion 52 has a diameter smaller than the root diameter of the spline portion 8.

With the starting apparatus for an internal combustion engine as constructed above, when an unillustrated starting switch is turned on, the unillustrated electromagnetic coil of the electromagnetic portion is supplied with electric power to be energized to move the plunger in one direction, whereby the shift lever 5 is caused to rotate in a seesaw-like manner, thus pushing the one-way clutch 6 to the right in FIG. 1. As a result, the one-way clutch 6 is forced to move to together with the pinion 9 while being rotated in accordance with the lead angle of the helical spline 12, so that the pinion 9 is placed into meshing engagement with the ring gear. Thereafter, when the electric motor is energized, the rotation shaft of the electric motor is driven to rotate, and the rotation force of the rotation shaft is transmitted to the driven member 15 through the intermediary of the drive shaft 4, the drive member 13 and the roller 14, so that the pinion shaft 7 and the pinion 9 made integral with the driven member 15 are caused to rotate together with the driven member 15. In accordance with the rotation of the pinion 9, the ring gear meshed with the pinion 9 is driven to rotate, thereby starting the internal combustion engine.

After starting of the internal combustion engine, the power supply to the electromagnetic coil of the electromagnetic portion is stopped so that the plunger is caused to return to its original position, which was take prior to the energization of the plunger, by means of the elastic force of the elastic member in the electromagnetic portion. However, in accordance with the movement of the plunger, the shift lever 5 is caused to rotate in a seesaw-like fashion, whereby the one-way clutch 6 is urged to return to its original position as taken prior to the starting of the internal combustion engine. As a result, the meshing engagement between the pinion 9 and the ring gear is released.

Thereafter, the power supply to the electric motor is also cut off to stop the rotation of the drive shaft 4 whereby the starting apparatus of the internal combustion engine is returned to the original state before the engine starting.

In the pinion slip-off preventive structure 50 as constructed above, the snap ring 17 is arranged in the groove 51 formed on the smooth surface of the projected portion 52. Therefore, the pressure-receiving area of the snap ring 17 in this embodiment increases as compared with the case where the elastic load of the elastic member 10 applied to the snap ring 17 in the known apparatus is supported by the spline portion 8. As a consequence, the bearing applied to the snap ring 17 is accordingly reduced, making the snap ring 17 less prone to being worn out and damaged.

In addition, since the diameter of the projected portion 52 is smaller by a length of d than the root diameter of the spline 8, the pinion 9 can be easily mounted on the pinion shaft 7.

The procedure for mounting the pinion 9 on the pinion shaft 7 is as follows. First, the stopper 57 is inserted to a position at which it goes beyond the groove 51. That is, the pinion 9 is inserted into the pinion shaft 7 from one side of the projected portion 52 in such a manner that a part of the support portion 55 of the stopper 57 overlaps the pinion shaft 7. Thereafter, the snap ring 17 is fitted in the groove 51, and the pinion 9 and the stopper 57 are then moved toward the side remote from the one-way clutch 6, whereby the engaging portion 56 of the stopper 57 is engaged with the snap ring 17. In this manner, the work of mounting the pinion 9 to the pinion shaft 7 is completed.

Embodiment 2.

Figure 3:
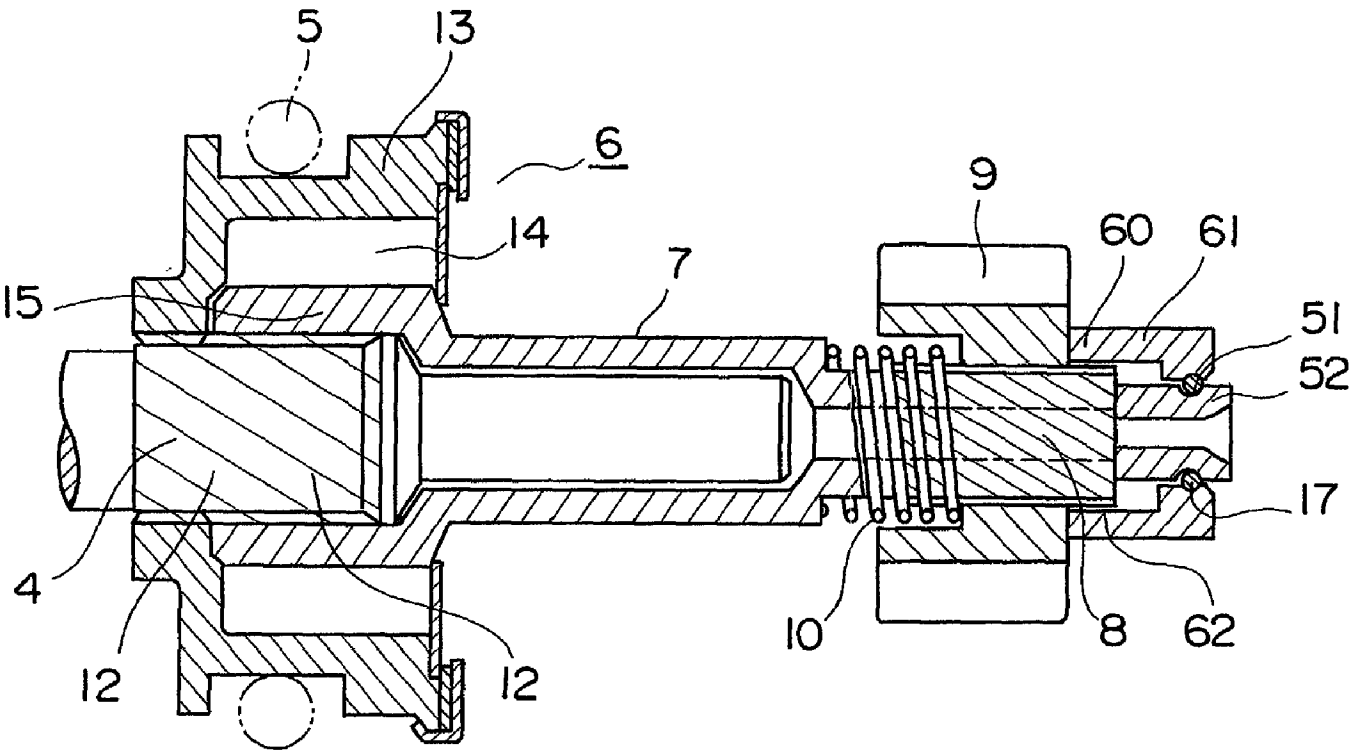
FIG. 3 is a partial cross sectional view of a starting apparatus for an internal combustion engine according to a second embodiment of the present invention.

FIG. 3 illustrates, in a partial cross section, a starting apparatus for an internal combustion engine according to a second embodiment of the present invention. This second embodiment differs from the first embodiment in that the support portion 60 of the stopper 61 is formed, at its end near the pinion 9, to enclose one end of the pinion shaft 7 with a gap or space 62 formed therebetween.

In the second embodiment, since the support portion 60 encloses, at its side near the pinion 9, the one end of the pinion shaft 7, even if the tip end of the stopper 61 strikes against a certain component part of an internal combustion engine upon installing the starting apparatus on the internal combustion engine so that the stopper 61 is subjected to a load acting in a direction inclined with respect to the axis of the stopper 61, the stopper 61 is positively restricted from being inclined relative to the pinion shaft 7, thus preventing the stopper 61 from being disengaged from the snap ring 17.

Moreover, since there is the gap or space 62 formed between the one end of the pinion shaft 7 and the support portion 60, it is possible to mount the support portion 60 on the end of the pinion shaft 7 without difficulty.

Embodiment 3.

Figure 4:
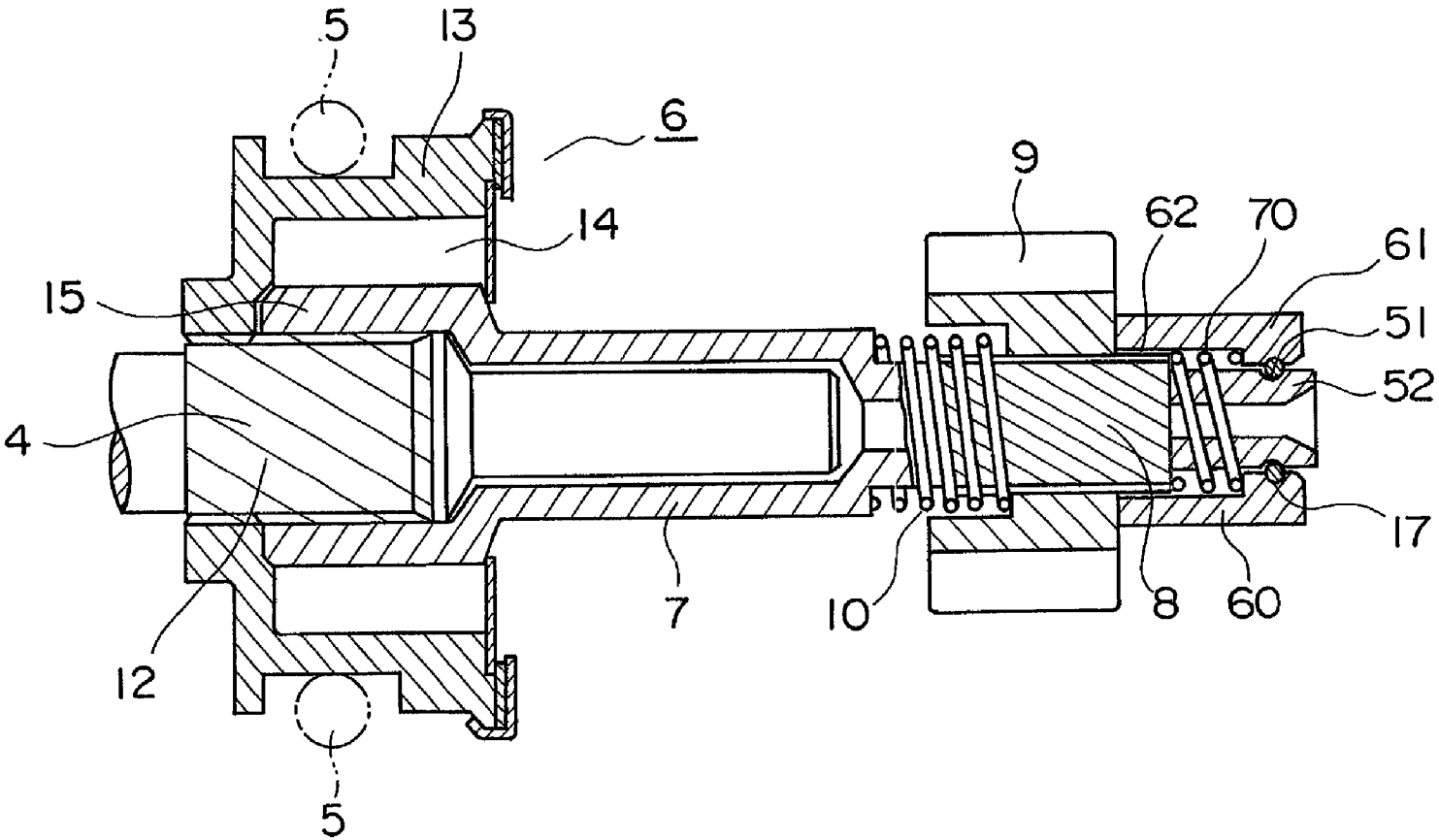
FIG. 4 is a partial cross sectional view of a starting apparatus for an internal combustion engine according to a third embodiment of the present invention.

FIG. 4 illustrates, in a partial cross section, a starting apparatus for an internal combustion engine according to a third embodiment of the present invention. This third embodiment differs from the second embodiment in that a spring 70 is provided on the projected portion 52 for urging the stopper 61 in a direction toward the ring gear.

In the third embodiment, since the stopper 61 is always urged to the ring gear side under the action of the elastic force of the spring 70 regardless of the movement of the pinion 9, it is possible to prevent displacement of the snap ring 17 in the groove 51 of the projected portion 52 during movement of the pinion 9 (particularly, when the pinion 9 moves in a direction away from the ring gear). Consequently, the amount of wearing of the snap ring 17 and the generation of noise can be reduced.

Here, it is to be noted that though in the above-mentioned respective embodiments, there have been shown and described pinion slip-off preventive structures for a starting apparatus in which the one-way clutch 6 and the pinion shaft 7 are movable to the ring gear side, the present invention can of course be applied to a pinion slip-off preventive structure of a starting apparatus in which the one-way clutch is fixed and the pinion shaft is movable to the ring gear side.

As described in the foregoing, a pinion slip-off preventive structure of a starting apparatus according to the present invention includes a projected portion extending from an end face of a pinion shaft in an axial direction thereof and having a groove formed on a smooth surface thereof in a circumferential direction thereof, a snap ring fitted in the groove, and a stopper having an abutting surface in abutting engagement with an end face of the pinion and an engaging portion engaged with the snap ring. With this arrangement, the pressure-receiving area of the snap ring supporting an elastic load applied thereto from an elastic member increases so that the bearing applied to the snap ring is accordingly reduced, making the snap ring less prone to being worn out and damaged. As a result, the pinion becomes less liable to slip or come off the pinion shaft.

Further, according to a preferred form of the present invention, the projected portion has a diameter smaller than a root diameter of the spline portion. Thus, the pinion can be easily mounted on the pinion shaft.

Moreover, according to another preferred form of the present invention, the pinion slip-off preventive structure of a starting apparatus further includes a support portion having an abutting surface and extending in an axial direction of the pinion shaft, the support portion having one end near the pinion formed to enclose an end of the pinion shaft. With this arrangement, when a load inclined with respect to the axis of the stopper is applied to the stopper, an inclination of the stopper due to the load is effectively restricted, and hence the stopper can be prevented from slipping or coming off the projected portion.

In addition, according to a further preferred form of the present invention, a space is formed between the one end of the pinion shaft and the support portion. Thus, the support portion can be easily mounted on the one end of the pinion shaft.

Furthermore, according to a yet further preferred form of the present invention, the pinion slip-off preventive structure of a starting apparatus further includes a spring mounted on the projected portion for urging the stopper in a direction toward the ring gear. With this arrangement, it is possible to prevent displacement of the snap ring in the groove of the projected portion during movement of the pinion. Consequently, the amount of wearing of the snap ring and the generation of noise can be reduced.

While the invention has been described in terms of preferred embodiments, those skilled in the art will recognize that the invention can be practiced with modifications within the spirit and scope of the appended claims.

What is claimed is:

1. A pinion slip-off preventive structure of a starting apparatus in which a pinion is prevented from slipping off a pinion shaft, said pinion being splined to a spline portion formed on said pinion shaft and being in meshing engagement with a ring gear of an internal combustion engine while urged in a direction toward said ring gear from a side remote therefrom by means of an elastic member, said structure comprising:

a projected portion extending from an end face of said pinion shaft in an axial direction thereof and having a groove formed on a smooth surface thereof in a circumferential direction thereof;

a snap ring fitted in said groove; and a stopper having an abutting surface in abutting engagement with an end face of said pinion and an engaging portion engaged with said snap ring.

2. The pinion slip-off preventive structure of a starting apparatus according to claim 1, wherein said projected portion has a diameter smaller than a root diameter of said spline portion.

3. The pinion slip-off preventive structure of a starting apparatus according to claim 1, further comprising a support portion having an abutting surface and extending in an axial direction of said pinion shaft, said support portion having one end near said pinion formed to enclose an end of said pinion shaft.

4. The pinion slip-off preventive structure of a starting apparatus according to claim 3, wherein a space is formed between the one end of said pinion shaft and said support portion.

5. The pinion slip-off preventive structure of a starting apparatus according to claim 1, further comprising a spring mounted on said projected portion for urging said stopper in a direction toward said ring gear.

* * * * *